United States Patent [19]

Sakai

[11] 4,407,917

[45] * Oct. 4, 1983

[54] INFORMATION IMAGE SYNTHESIZING AND COPYING METHOD

[75] Inventor: Katsuo Sakai, Yokohama, Japan

[73] Assignee: Ricoh Company, Ltd., Japan

[ * ] Notice: The portion of the term of this patent subsequent to Feb. 10, 1998 has been disclaimed.

[21] Appl. No.: 68,666

[22] Filed: Aug. 22, 1979

[30] Foreign Application Priority Data

Aug. 28, 1978 [JP] Japan ..... 53-104727

[51] Int. Cl.[3] ..... G03G 13/01

[52] U.S. Cl. ..... 430/42; 355/3 R; 355/4; 430/55

[58] Field of Search ..... 355/3 R, 4; 430/42, 430/46, 47, 57

[56] References Cited

U.S. PATENT DOCUMENTS

| | | | |
|---|---|---|---|
| 2,962,374 | 11/1960 | Dessauer | 430/46 |
| 2,962,375 | 11/1960 | Schaffert | 430/47 X |
| 3,692,519 | 9/1972 | Takahashi | 430/42 |
| 3,702,483 | 11/1972 | Fantuzzo | 355/4 X |
| 3,832,170 | 8/1974 | Nagamatsu et al. | 355/4 X |
| 3,992,204 | 11/1976 | Taylor | 430/46 |
| 4,189,224 | 2/1980 | Sakai | 355/4 |
| 4,228,231 | 10/1980 | Kaukeinen et al. | 430/46 |
| 4,230,783 | 10/1980 | Aoki et al. | 430/46 X |
| 4,250,239 | 2/1981 | Sakai | 430/57 X |

*Primary Examiner*—Fred L. Braun

*Attorney, Agent, or Firm*—McGlew and Tuttle

[57] ABSTRACT

An information image of a first original and an information image of a second original are synthesized on a photoconductor which includes a photoconductive layer having a spectral sensitivity to A-colored light but not having a spectral sensitivity to B-colored light, and a photoconductive layer having a spectral sensitivity to B-colored light, but not having a spectral sensitivity to A-colored light, which are formed in layers on a conductive base member, by taking the steps of charging the photoconductor to a predetermined polarity and then charging the photoconductor to reverse the original surface potential of the photoconductor, while retaining the charges applied to the photoconductor, to the extent that latent electrostatic images can be formed on the surface of the photoconductor, and exposing the photoconductor to an A-colored light image corresponding to the information image of the first original and a B-colored light image corresponding to the information image of the second originals simultaneously and or one after another to form the synthesized latent electrostatic images of the two originals on the photoconductor, and finally developing the synthesized latent electrostatic images by one or two types of developers.

9 Claims, 3 Drawing Figures

INFORMATION IMAGE SYNTHESIZING AND COPYING METHOD

BACKGROUND OF THE INVENTION

The present invention relates to an information image synthesizing and copying method.

The information image synthesizing and copying method is a method of synthesizing information image $\alpha$ of original I and information image $\beta$ of original II and copying the synthesized information images $\alpha$ and $\beta$ on one copying sheet C as shown in FIG. 1. This method serves to save the material necessary for copying and is useful for information processing.

Conventionally, in one method of making synthesized copies, an original whose non-image portions are transparent is employed as the original I or the original II, and the original I and the original II are superimposed and copied. In another method, a latent electrostatic image corresponding to the original I and a latent electrostatic image corresponding to the original II are formed on two separate photoconductors and those latent electrostatic images are transferred to a recording sheet and the transferred latent electrostatic images are developed. In a further method, the latent electrostatic image of the original I is formed on one photoconductor and the electrostatic latent image is transferred to a recording sheet and the latent electrostatic image of the original II is formed on the same photoconductor and the electrostatic latent image is transferred to the same recording paper, and the transferred latent electrostatic images are developed.

The first method has a shortcoming that a special transparent original is required as the original I or the original II. The second method requires two photoconductors and the copying apparatus employing this method is complicated in the mechanism. In the third method, a process of the formation of the latent electrostatic image and transfer thereof has to be repeated two times, which reduces the copying efficiency.

SUMMARY OF THE INVENTION

It is therefore an object of the present invention to provide and information image synthesizing and copying method capable of performing the synthesis of information images and copying of the synthesized information images simply and efficiently.

According to the present invention, a photoconductor comprises a conductive base member, a first photoconductive layer formed on the conductive base and a second photoconductive layer formed on the first photoconductive layer. The first photoconductive layer has a spectral sensitivity to A-colored light but does not have a spectral sensitivity to B-colored light. On the other hand, the second photoconductive layer has a spectral sensitivty to B-colored light but does not have a spectral sensitivity to A-colored light. The photoconductor is charged to a predetermined polarity by a first charging in the dark or under uniform exposure using A-colored light or B-colored light. In one embodiment according to the present invention, charges in the polarity opposite to that of the first charging are then applied to the photoconductor to reverse the original polarity of the surface potential of the photoconductor, while retaining the charges applied to the photoconductor during the first charging to the extent that latent electrostatic images can be formed on the surface of the photoconductor. The photoconductor is then exposed to an A-colored light image corresponding to an information image $\alpha$ of a first original I and to a B-colored light image corresponding to an information image $\alpha$ of a second original II simultaneously or one after another to form the synthesized latent electrostatic images of the first original I and the second original II. The synthesized latent electrostatic images are developed by two types of toners which are charged in the opposite polarities.

DETAILED DESCRIPTION OF THE PREFERRED EMBODIMENT

Figure 2:
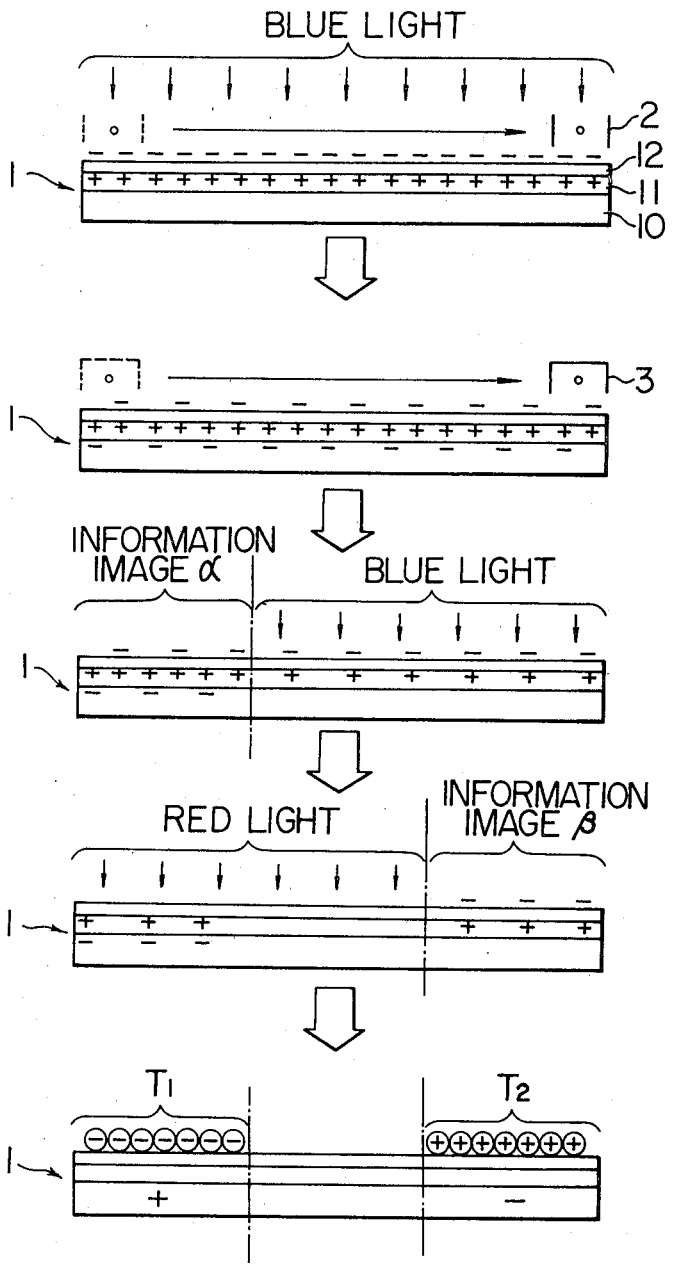
FIG. 2 shows, diagramatically, the information image synthesizing and copying process according to the present invention.

Referring to FIG. 2, there is shown a photoconductor 1 which is employed in the present invention.

The photoconductor 1 comprises a conductive base member 10 and photoconductive layers 11 and 12 formed on the conductive base member 10. The photoconductive layers 11 and 12 have different spectral sensitivities. For instance, the photoconductive layer 11 is sensitive to A-colored light, but is not sensitive to B-colored light. On the other hand, the photoconductor layer 12 is not sensitive to A-colored light, but it is sensitive to B-colored light. More specifically, in the present embodiment, the A-color is blue and the B-color is red, and the photoconductive layer 11 comprises selenium, while the photoconductive layer 12 comprises zinc oxide.

The information image synthesizing and copying method according to the present invention starts with the step of electrically charging the surface of the photoconductor 1 to a predetermined polarity by a charger 2. This charging process is referred to as a first charging. With respect to the polarity of the first charging, either positive polarity or negative polarity is selected. In the present embodiment, negative polarity is employed and the first charging is performed under uniform exposure of the photoconductor 1, using blue light. The blue light is transmitted through the photoconductive layer 12, without making the photoconductive layer 12 conductive and is absorbed by the photoconductive layer 11, making the photoconductive layer 11 conductive.

The surface of the photoconductive layer 12 is charged uniformly by negative charges applied from the charger 2. Positive charges injected from the conductive base member 10 into the photoconductive layer 11 are moved through the photoconductive layer 11 by the induction of the negative charges on the upper surface of the photoconductive layer 12. As a result, positive charges are distributed in the interface where the photoconductive layers 11 and 12 meet. Since selenium is used as the photoconductive layer 11 and it has a characteristic that injection and movement of positive charges occur even in the dark, even if the first charging is performed in the dark, the same effect as mentioned above can be produced.

After completion of the first charging, positive charges are applied to the surface of the photoconductor 1 by a charger 3. This charging is performed in the polarity opposite to that of the first charging and is referred to as a second charging step. The second charging is performed in such a manner that the polarity of the surface potential of the photoconductor 1 is sufficiently reversed while retaining negative charges applied by the first charging on the surface of the photoconductor 1, to the extent that latent electrostatic images can be formed on the surface of the photoconductor 1. More specifically, as positive charges are applied to the photoconductor 1 by the charger 3, negative charges that have been applied by the first charging to the surface of the photoconductive layer 12 are gradually neutralized and accordingly the surface potential of the photoconductor 1 is gradually decreased. With a furhter neutralization of negative charges, the surface potential of the photoconductor 1 becomes zero (0) and the polarity of the surface potential of the photoconductor 1 is then reversed to positive by the effect of positive charges on the back or under side of the photoconductive layer 12. The surface potential of the photoconductor 1, being sufficiently reversed in polarity, signifies that the surface potential of the photoconductor 1, with its polarity reversed to positive, is sufficient for the formation of a electrostatic image on the surface of the photoconductor 1 and the sufficient retaining of negative charges signifies that the amount of negative charges is sufficient for the formation of an electrostatic image.

In other words, when the second charging has been completed, the surface of the photoconductor 1 is charged by negative charges sufficiently capable of forming electrostatic images thereon, while the photoconductor 1, as a whole, has a sufficient positive surface potential for the formation of electrostatic images.

Exposure of the photoconductor 1 to a blue light image of original I is then performed. This exposure can be performed by several methods.

First, assume that original I is an information image $\alpha$ on white paper. The color of the information image $\alpha$ is not limited to black, but the complementary color of blue can be used. In one method for exposing the photoconductor 1 to the blue light image of the original I, the original I is directly illuminated by blue light and the photoconductor 1 is exposed to the reflected light from the original I. In another method, the original I is illuminated by white light and the reflected light from the original I is filtered through a blue color filter for color separation and the photoconductor 1 is exposed to the color separated light image of the original I. In a further method, the background of the original I is made blue in color and the information image is written using a complementary color of black or of blue. The thus formed original I is illuminated by white light or blue light and the photoconductor 1 is exposed to the reflected light from the original I. In any case, the photoconductor 1 is exposed to the blue light image of the original I. When the blue light image of the original I is projected onto the photoconductor 1, a portion of the photoconductor 1, corresponding to information image $\alpha$ of the original I, is not exposed to the blue light. Therefore, the surface potential of this portion remains positive in polarity and the value of the surface potential after the second charging is the same as before if the dark decay of the surface potential is negligible. On the other hand, the rest or remaining portion of the photoconductor 1, corresponding to the non-image or blank area of the original I, is exposed to the blue light and only the photoconductive layer 11 is made conductive, so that part of positive charges on the back side of the photoconductive layer 12 flows into the conductive base member 10 and the rest of positive charges on the back side of the photoconductive layer 12 and the negative charges on the upper surface of the photoconductive layer 12 are balanced, whereby the polarity of the surface potential in this portion is again reversed to negative. As mentioned previously, the surface potential of the portion whose polarity is reversed to a negative polarity is high enough to form electrostatic images.

The exposure using a red light image of an original II is then performed. In this exposure, exactly the same exposure method can be employed as in the case of the exposure using the blue light image of the original I. A portion of the photoconductor 1, corresponding to the information image $\beta$ of the red light image of the original II, is not exposed to the red light. Therefore, the surface potential of this portion remains in the negative polarity. The rest or remaining portion of the photoconductor 1, corresponding to the non-image or blank area of the original II, is exposed to the red light. The rest or remaining portion includes not only the blank or non-image portion common to the original I and the original II but also the portion corresponding to the information image $\alpha$ of the original I.

When the red light image has not yet been projected onto the photoconductor 1, positive charges and negative charges on both sides of the photoconductive layer 12 are balanced in the portion corresponding to the common blank portions of the original I and the original II. Therefore, when only the photoconductive layer 12 is made conductive by the projection of the red light image, the positive charges and the negative charges neutralize each other, so that these surface potential in the portions of the photoconductor 1 becomes zero (0).

Furthermore, before the red light image is projected to the photoconductor 1, the portion of the photoconductor 1, corresponding to the information image $\alpha$ of the original I retains the same charge distribution as that after the second charging. Therefore, when the photoconductor 1 is illuminated by the red light, negative charges on the surface of the photoconductive layer 12 are neutralized by part of positive charges on the back side of the photoconductive layer 12, whereby only the positive charges contribute to the surface potential of this portion of the photoconductor 1. As a result, after the exposure of the photoconductor 1 to the red light image, the surface potential of this portion of the photoconductor 1 is positive in polarity and is increased further. A portion where the information image $\alpha$ and the information image $\beta$ are overlapped, if any, retains the same positive potential as that after the second charging.

Thus, the surface potential of the portion of the photoconductor 1, corresponding to the blank or non-image portion common to the originals I and II, becomes zero (0) and the portion having the surface potential with positive polarity and the portion having the surface potential with negative polarity are distributed so that electrostatic latent image portions corresponding to the information images $\alpha$ and $\beta$ are formed.

Figure 1:
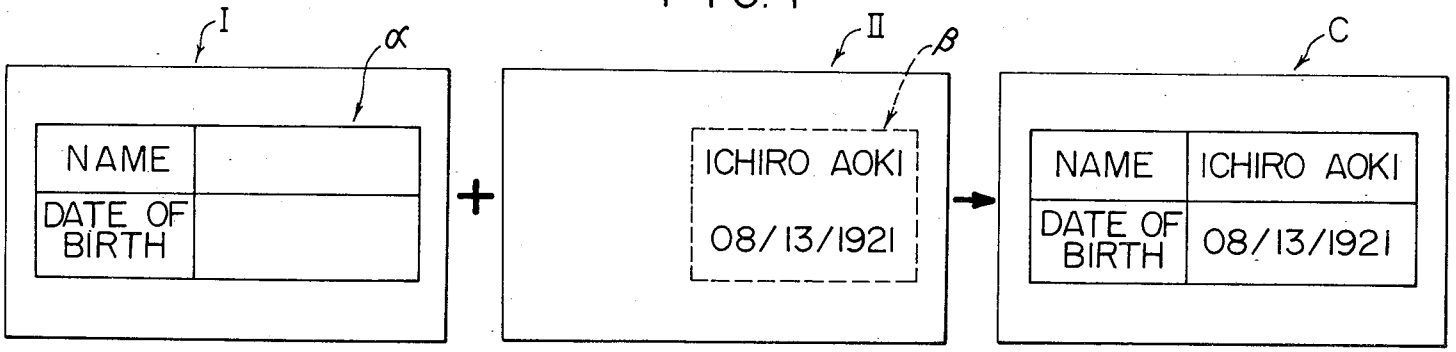
FIG. 1 shows examples of two originals from which a synthesized copy is to be made, and a synthesized copy.
Figure 3:
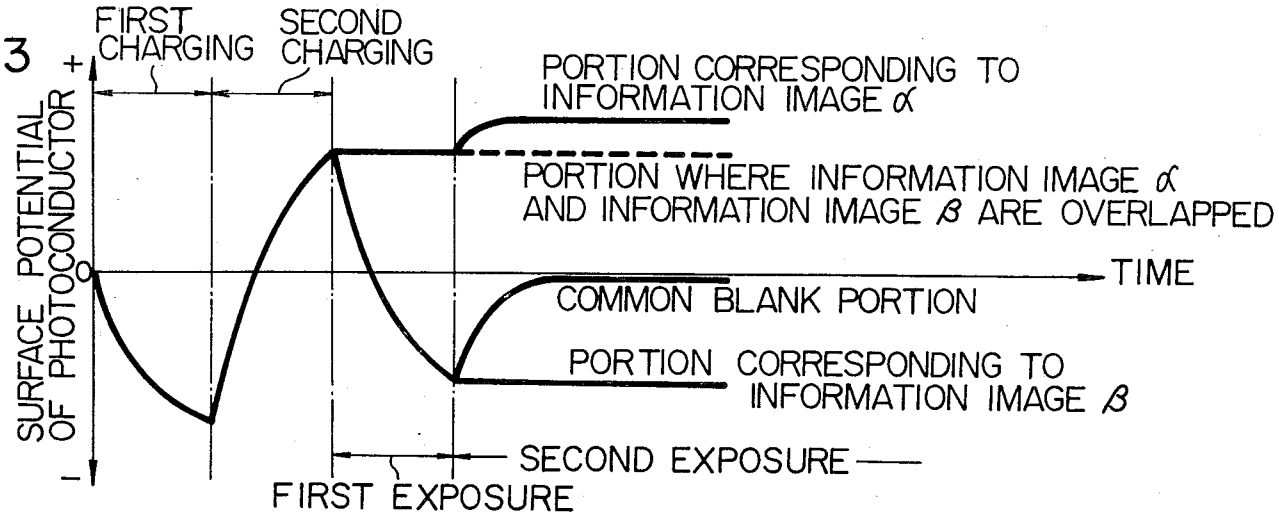
FIG. 3 shows, diagramatically, the change of the surface potential of a photoconductor during the information image synthesizing and copying process according to the present invention.

FIG. 3 shows the change of the surface potential of the photoconductor 1 during this process.

In the above-mentioned embodiment, the first charging is performed under uniform exposure using the blue light corresponding to the previously mentioned A-colored light.

If the first charging is performed under uniform exposure using the red light corresponding to the previously mentioned B-colored light, the second charging can be performed to the extent that latent electrostatic images opposite in polarity to the first charging can be formed on the surface of the photoconductor 1, without reversing the polarity of the surface potential of the photoconductor 1.

The synthesized latent electrostatic images formed on the surface of the photoconductor 1 are developed by two types of toners T1 and T2, which are charged in opposite polarities. The electrostatic latent image portion whose surface potential is in positive polarity is developed by negatively charged toner T1, so that a visible image of the the information image $\alpha$ is formed. On the other hand, the electrostatic latent image portion whose surface potential is in negative polarity is developed by positively charged toner T2, so that a visible image of the information image $\beta$ is formed.

The synthesized latent electrostatic images can be developed by a single conductive developer instead of the two types of toners.

The synthesized visible images of the information images $\alpha$ and $\beta$ formed on the photoconductor 1 are transferred to a recording sheet and fixed thereto, so that the synthetic information image copying process is completed.

The photoconductor 1 can be formed into a sheet so that the synthesized visible image formed on the sheet-formed photoconductor can be fixed to the photoconductor.

The following are the examples of the experiments conducted by the inventor of the present invention:

EXPERIMENT 1

An aluminum plate was employed as a conductive base member. Selenium with a purity of 99.99% was evaporated, to a thickness of 50$\mu$, onto the aluminum plate to form a first photoconductive layer. Onto the first photoconductive layer, a resin containing zinc oxide sensitized by methylene blue was coated with a thickness of 20$\mu$ to form a second photoconductive layer. The mixing ratio of methylene blue to zinc oxide was 0.0002 to 1 by weight, and the mixing ratio of zinc oxide to the resin was 2 to 1 by weight.

The photoconductor was subjected to a first charging in the dark until the surface potential of the photoconductor became −800 volts. A second charging was then conducted in the dark until the surface potential of the photoconductor became 700 volts.

An original bearing a black information image with white background was illuminated by blue light and the photoconductor was exposed to the blue light reflected from the original. The surface potential of the exposed area of the photoconductor became −320 volts, while the surface potential of the unexposed area of the photoconductor became +670 volts.

Then a second original, which had a black information image with white background, in a portion corresponding to the blank or non-image area of the first original, was illuminated by red light and the photoconductor was exposed to the red light reflected from the second original. The surface potential of the portion of the photoconductor, corresponding to the information image of the first original, became +950 volts, while the surface potential of the portion of the photoconductor, corresponding to information image of the second original, became −290 volts, and the surface potential of the portion of the photoconductor, corresponding to the blank or non-image area common to the first and second originals, become −20 volts. The synthesized electrostatic latent images were developed by a negatively charged toner for use with a PPC-900 (trade name) Copying Machine manufactured by RICOH CO., LTD. and a polsitively charged toner for the U-Bix (trade name) Copying Machine manufactured by Konishiroku Co., Ltd. and clear synthesized information images were obtained with a high resolution.

EXPERIMENT 2

In Experiment 1, positively charged red toner prepared by the inventor of the present invention was used instead of the negatively charged toner for U-Bix Copying Machine. As a result, the information image of the first original was reproduced black in color while the information image of the second original was reproduced red in color and clearly with a high resolution.

Thus, by use of two types of toners with different colors, each information image element of the synthesized information image can be copied with different colors.

EXPERIMENT 3

In Experiments 1 and 2, the photoconductor was exposed to the blue image of the first original and to the red light image of the second original simultaneously. The result was exactly the same as in Experiments 1 and 2. This indicates that the two exposures can be performed either separately or simultaneously, and when the two exposures are performed separately, the same result can be obtained regardless of the order of the two exposures.

EXPERIMENT 4

In Experiments 1 and 2, the first charging was conducted under uniform exposure using blue light. The result were exactly the same as in Experiments 1 and 2.

EXPERIMENT 5

In Experiments 1 and 2, the first charging was conducted under uniform exposure using red light. The results were almost the same as in Experiments 1 and 2.

What is claimed is:

1. A method of synthesizing the information image of a first original (I) and the information image of a second original (II) and copying the respective information images on one copying sheet, using a photoconductor comprising a conductive base member, a first photoconductive layer having a spectral sensitivity to A-colored light, but not having a spectral sensitivity to B-colored light, said first photoconductive layer formed on said conductive base member, a second photoconductive layer having a spectral sensitivity to said B-colored light but not having a spectral sensitivity to said A-colored light, said second photoconductive layer formed on said first photoconductive layer, comprising the steps of:

performing a first charging for charging a photoconductor to a predetermined polarity under the illumination of light capable of making either said first photoconductive layer or said second photoconductive layer conductive, performing a second charging for applying charges of the polarity opposite to the polarity of said first charging to said photoconductor, exposing said photoconductor to an A-colored light image of said first original (I) and a B-colored light image of said second original (II), forming synthesized latent electrostatic images, in which the surface potential of a portion of said photoconductor, corresponding to the blank portions common to said originals (I) and (II), is nearly zero, and the surface potential of a portion of said photoconductor, corresponding to information image of said first original (I), and the surface potential of a portion of said photoconductor, corresponding to information image of said second original (II) are opposite in the polarity, and developing said synthesized latent electrostatic images by developer.

2. A method of synthesizing the information image of a first original (I) and the information image of a second original (II) and copying the respective information images on one copying sheet as in claim 1, wherein said first charging is performed under uniform exposure of said photoconductor, using the A-colored light, and said second charging is performed, while retaining the charges applied to said photoconductor during said first charging to the extent that latent electrostatic images can be formed on the surface of said photoconductor, with the polarity of the surface potential of said photoconductor reversed.

3. A method of synthesizing the information image of a first original (I) and the information image of a second original (II) and copying the respective information images on one copying sheet as claimed in claim 1, wherein said first charging is performed under uniform exposure using the B-colored light, and said second charging is performed to the extent that latent electrostatic images opposite in polarity to said first charging can be formed on the surface of said photoconductor, without reversing the polarity of the surface potential of said photoconductor.

4. A method of synthesizing the information image of a first original (I) and the information image of a second original (II) and copying the respective information images on one copying sheet as in claim 1, wherein said photoconductor is exposed to the A-colored light image of said original (I) and the B-colored light image of second original (II) simultaneously.

5. A method of synthesizing the information image of a first original (I) and the information image of a second original (II) and copying the respective information images on one copying sheet as in claim 1, wherein said photoconductor is exposed to the A-colored light image of said original (I) and the B-colored light image of said second original (II) one after the other.

6. A method of synthesizing the information image of a first original (I) and the information image of a second original (II) and copying the respective information images on one copying sheet, using a photoconductor comprising a conductive base member, a first photoconductive layer having a spectral sensitivity to A-colored light, but not having a spectral sensitivity to B-colored light, said first photoconductive layer formed on said conductive base member, and said first photoconductive layer having a property of rectification with respect to said conductive base member, a second photoconductive layer having a spectral sensitivity to said B-colored light but not having a spectral sensitivity to said A-colored light, said second photoconductive layer formed on said first photoconductive layer, comprising the steps of:

performing a first charging for charging a photoconductor to a predetermined polarity in the dark, performing a second charging for applying charges of the polarity opposite to the polarity of said first charging to said photoconductor, while retaining the charges applied to said photoconductor during said first charging to the extent that latent electrostatic images can be formed on the surface of said photoconductor, with the polarity of the surface potential of said photoconductor reversed, exposing said photoconductor to an A-colored light image of said first original (I) and a B-colored light image of said second original (II), forming synthesized latent electrostatic images, in which the surface potential of a portion of said photoconductor, corresponding to the blank portions common to said originals (I) and (II), is nearly zero, and the surface potential of a portion of said photoconductor, corresponding to information image of said first original (I), and the surface potential of a portion of said photoconductor, corresponding to information image of said second original (II) are opposite in the polarity, and developing said synthesized latent electrostatic images by developer.

7. A method of synthesizing the information image of a first original (I) and the information image of a second original (II) and copying the respective information images on one copying sheet as in claim 6, wherein said photoconductor is exposed to the A-colored light images of said original (I) and the B-colored light image of said second original (II) simultaneously.

8. A method of synthesizing the information image of a first original (I) and the information image of a second original (II) and copying the respective information images on one copying sheet as in claim 6, wherein said photoconductor is exposed to the A-colored light image of said original (I) and B-colored light image of said second original (II) one after the other.

9. A method for synthesizing and copying a first and second image from a first original (I) and a second original (II) respectively, onto one copy sheet comprising:

providing a photoconductor having a first layer which is spectrally sensitive to a first colored light but not to a second colored light, a second layer which is spectrally sensitive to the second colored light but not to the first colored light, the second layer being superposed on the first layer and the photoconductor being exposable in a single cycle to form an electrostatic image thereon;

providing first charge means for charging the photoconductor to one charged polarity;

charging the photoconductor to one charged polarity during one cycle;

providing second charge means for charging the photoconductor to an opposite charged polarity while retaining at least some of the charge of the one polarity;

charging the photoconductor to the opposite charged polarity while retaining at least some of the charge of the one polarity during said one cycle;

providing first light exposure means for exposing the photoconductor to the first image of the first original (I) in the first colored light;

exposing the first original (I) having the first image to the first colored light during said one cycle;

providing second light exposure means for exposing the photoconductor to the second image of the second original (II) in the second colored light;

exposing the second original (II) having the second image to the second colored light during said one cycle;

providing image developing means engageable with the photoconductor for developing electrostatic latent images of the first and second images formed thereon into visible images during said one cycle; and developing said electrostatic latent images during said one cycle.

* * * * *